US009180470B2

(12) United States Patent
Zhou et al.

(10) Patent No.: US 9,180,470 B2
(45) Date of Patent: Nov. 10, 2015

(54) ASSEMBLY FOR PRODUCING FORFICIFORM SPRAY

(75) Inventors: Huasong Zhou, Xiamen (CN); Yangfeng Ji, Xiamen (CN); Jianmin Chen, Xiamen (CN); Zunyu Cai, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 236 days.

(21) Appl. No.: 13/976,899

(22) PCT Filed: Dec. 23, 2011

(86) PCT No.: PCT/CN2011/084546

§ 371 (c)(1), (2), (4) Date: Jun. 27, 2013

(87) PCT Pub. No.: WO2012/089071

PCT Pub. Date: Jul. 5, 2012

(65) Prior Publication Data

US 2013/0270367 A1 Oct. 17, 2013

(30) Foreign Application Priority Data

Dec. 29, 2010 (CN) ..... 2010 2 0688029

(51) Int. Cl.

| | |
|---|---|
| ***B05B 1/04*** | (2006.01) |
| ***B05B 1/08*** | (2006.01) |
| ***B05B 7/04*** | (2006.01) |
| ***E03C 1/084*** | (2006.01) |
| ***B05B 1/34*** | (2006.01) |

(52) U.S. Cl.

CPC ..... *B05B 7/0425* (2013.01); *B05B 1/04* (2013.01); *B05B 1/08* (2013.01); *B05B 1/341* (2013.01); *E03C 1/084* (2013.01)

(58) Field of Classification Search

CPC ..... B05B 1/04; B05B 1/044; B05B 1/048; B05B 1/08; B05B 7/0425; E03C 7/0425

See application file for complete search history.

(56) References Cited

U.S. PATENT DOCUMENTS

| | | | | |
|---|---|---|---|---|
| 2,069,733 | A * | 2/1937 | Zinkil | 239/403 |
| 3,216,439 | A * | 11/1965 | Manion | 137/810 |
| 3,654,944 | A * | 4/1972 | Laakaniemi et al. | 137/823 |
| 6,497,375 | B1 * | 12/2002 | Srinath et al. | 239/589.1 |
| 6,575,386 | B1 * | 6/2003 | Thurber et al. | 239/418 |
| 6,581,856 | B1 * | 6/2003 | Srinath | 239/589.1 |

FOREIGN PATENT DOCUMENTS

| | | | |
|---|---|---|---|
| CN | 2406734 | Y | 11/2000 |
| CN | 201008815 | Y | 1/2008 |
| CN | 201586586 | U | 9/2010 |
| FR | 2711553 | A1 | 5/1995 |
| JP | 7-31902 | A | 2/1995 |
| JP | 2003-205256 | A | 7/2003 |

* cited by examiner

*Primary Examiner* — Ryan Reis
(74) *Attorney, Agent, or Firm* — Rabin & Berdo, P.C.

(57) ABSTRACT

The present invention is provided with an assembly for producing forficiform spray, which comprising a base body, the base body is disposed with a waterway inside; the waterway includes an inlet, an outlet and a circular cavity, the circular cavity is connected between the inlet and the outlet; the diameter of the outlet is larger than that of the inlet, the outlet is conical shaped with big end down; the joint of the inlet and the circular cavity is chamfered arc. When water flows into the cavity from the inlet, with the characteristics of the water, the outlet water forms a forficiform water of periodicity open and close; the present invention is full in granule, better suction effect, visual effect and massage effect.

9 Claims, 7 Drawing Sheets

ASSEMBLY FOR PRODUCING FORFICIFORM SPRAY

FIELD OF THE INVENTION

The present invention relates to an assembly for producing a forficiform spray.

BACKGROUND OF THE INVENTION

In the exiting technology, especially in switch assembly in a shower or a nozzle, there are fewer assemblies to produce a forficiform spray that will periodically open and close; the existing technology has problems that the period of the forficiform spray is unstable, the water splash is dull, the water is weak in granule and weak in suction effect, and intermittently leaking may happen during suction.

SUMMARY OF THE INVENTION

The object of the present invention is to solve the problems of the existing technology that the period of the forficiform spray is unstable, the water splash is dull, the water is weak in granule and weak in suction effect and intermittently leaking may happen during suction.

To solve above problems, the present invention is applied with a technical proposal as below:

An assembly for producing forficiform spray, comprising a base body, the base body is disposed with a waterway inside; the waterway includes an inlet, an outlet and a circular cavity, the circular cavity is connected between the inlet and the outlet; the diameter of the outlet is larger than that of the inlet, the outlet is conical shaped with big end down; the base body is disposed with an air hole throughout of the circular cavity inside and outside.

The joint of the inlet and the circular cavity is a chamfered arc.

The base body includes a cavity body, which includes a main water body and a cover, the main water body is disposed with the inlet, the outlet and a circular groove connected between the inlet and the outlet, the main water body is fixed to the cover; the circular groove is formed the circular cavity.

The base body further includes an inlet nozzle, the centre of which is a hollow inlet waterway, one end of the inlet nozzle is disposed with external threaded, the other end is a flanged base, the flanged base is disposed with thread holes, the upper end of the cavity is disposed with thread holes corresponding to the thread holes of the flanged base of the inlet nozzle in position and size.

The bottom of the circular groove is in a same horizontal plane, the inlet and the outlet are separately disposed with the upper and the lower end of the circular groove in the radial direction; the outlet is forked tail shaped of big end down.

The air hole is disposed at the bottom of the circular groove in the position near the inlet.

The bottom of the circular groove of the main water body is disposed with two air holes.

Two air holes are symmetrically disposed in two sides of the line of the centers of the inlet and the outlet.

The end of the main water body and the cover near the inlet is disposed with an airway corresponding to the air hole in quantity and position, the airway is connected to the air hole.

A through hole is disposed in the flanged base of the inlet nozzle in the position corresponding to the airway.

The water from the inlet is stagnated in the joint of the inlet and the circular groove, and then the water is dispersed when it is running into the circular groove, one part of the water runs out of the outlet, the other part impacts two circular-like inner walls of the circular groove to form a feedback water; the feedback water and the main water from the inlet form a closed water cavity; the closed water cavity is gradually contracted to make the two air holes at the bottom of the circular groove worked with strong suction, making the air entering into the circular groove from the airway and the air hole; the air is mixed with the main water, making the specific volume of the mixture doubled and increased; when the mixture is running out of the outlet in high speed, one part is adhesion to the two sides of the forktail-like outlet, increasing the spraying area;

The other time the volume of the inlet is less than that of the outlet, water in two sides of the outlet is dropping down, one part of the water is directly running out of the outlet, reducing the spraying area; the other part of the water impacts the walls of the circular groove again to form feedback water, the feedback water and the main water from the inlet form closed water cavity again, the closed water cavity is contracted again, making the air hole worked with suction again, again the water is sprayed with large area from the forktail-like outlet, the water is forficiform water.

The present invention is provided with an assembly for producing forficiform spray, the period of forficiform spray is stable, the water is full in granule, the suction effect is obvious, and it has well visual effect. When the present invention is assembled in a massage nozzle, the forficiform spray is good for the body with well massage effect. And the assembly is simple in structure and low in cost. It is assembled by bolt, making it easy to clean.

BRIEF DESCRIPTION OF THE DRAWINGS

The present invention will be further described with drawings and embodiments.

DETAILED DESCRIPTION OF THE EMBODIMENTS

Figure 1:
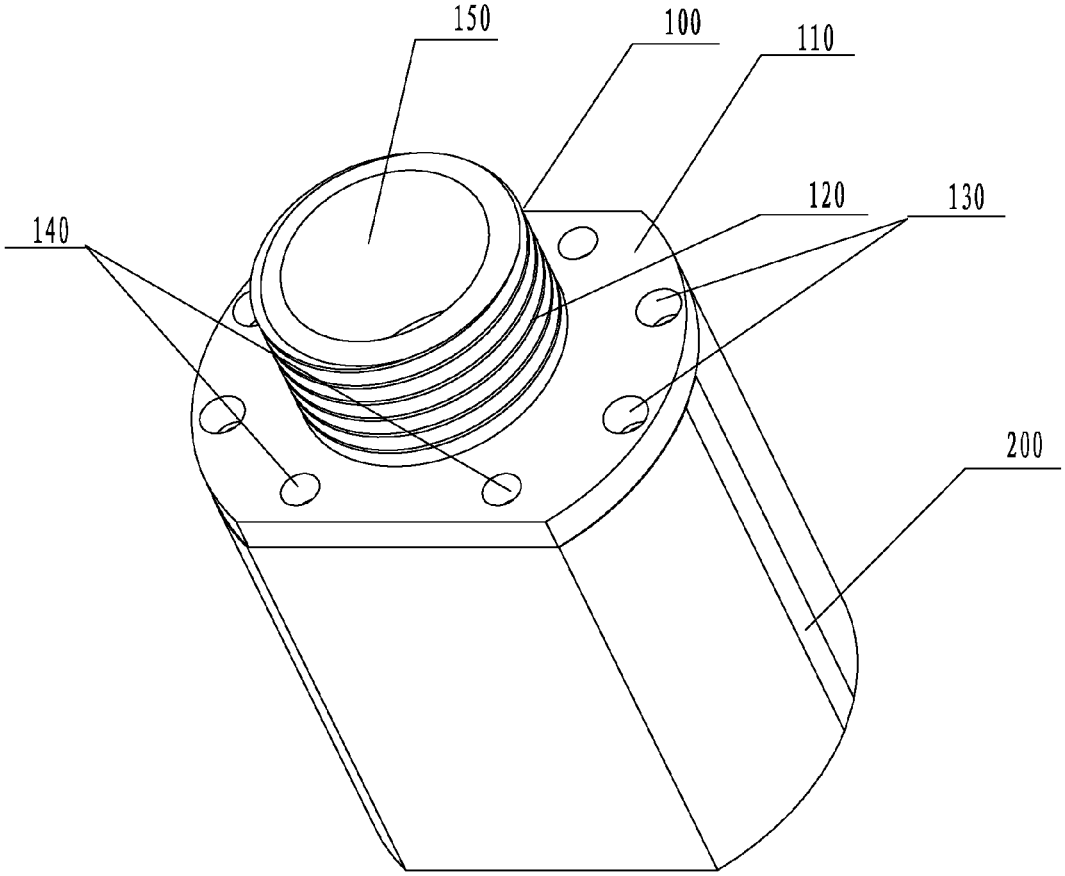
FIG. 1 illustrates the structure of a preferred embodiment of the present invention.
Figure 2:
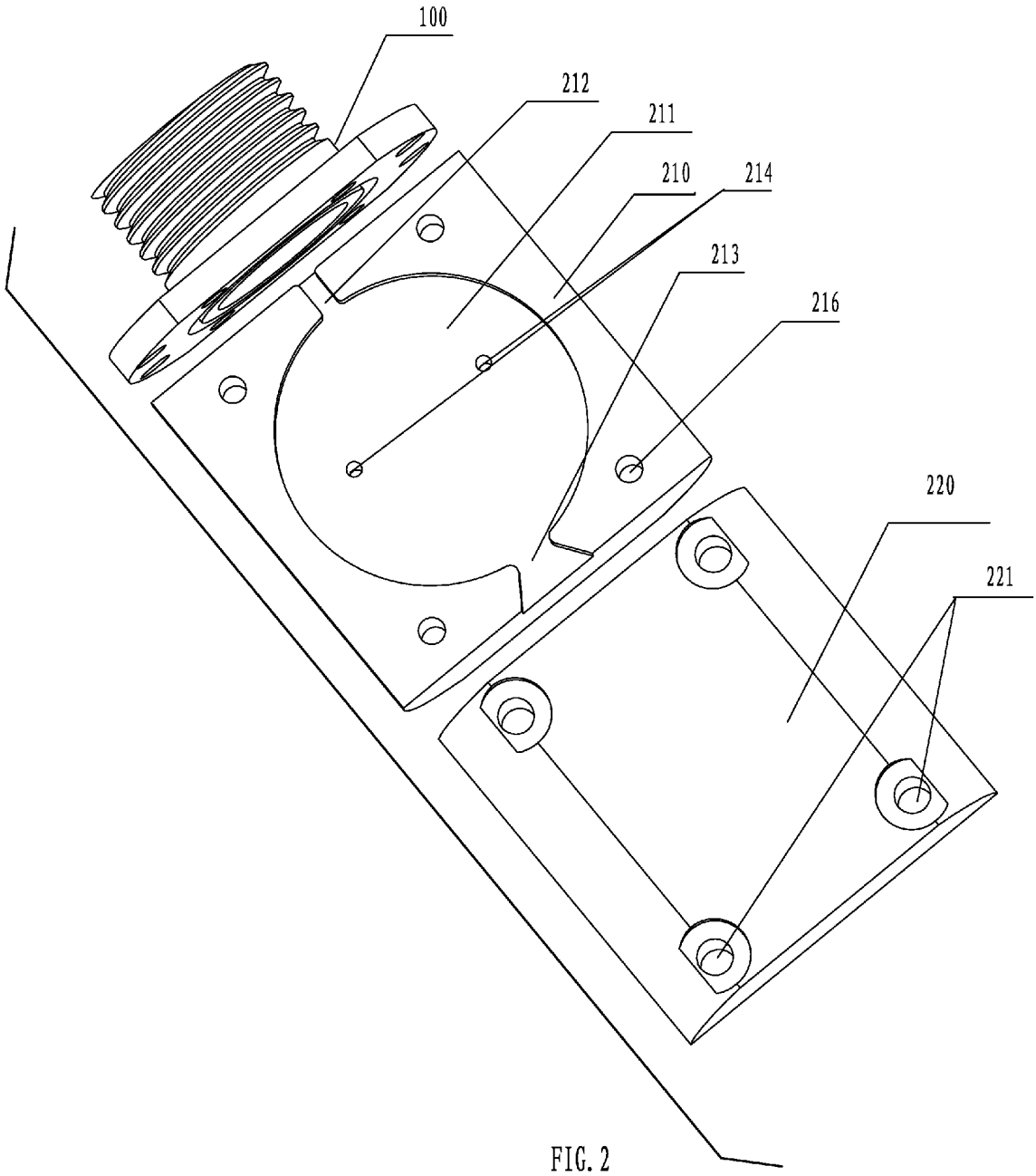
FIG. 2 illustrates the breakdown structure of a preferred embodiment of the present invention.
Figure 3:
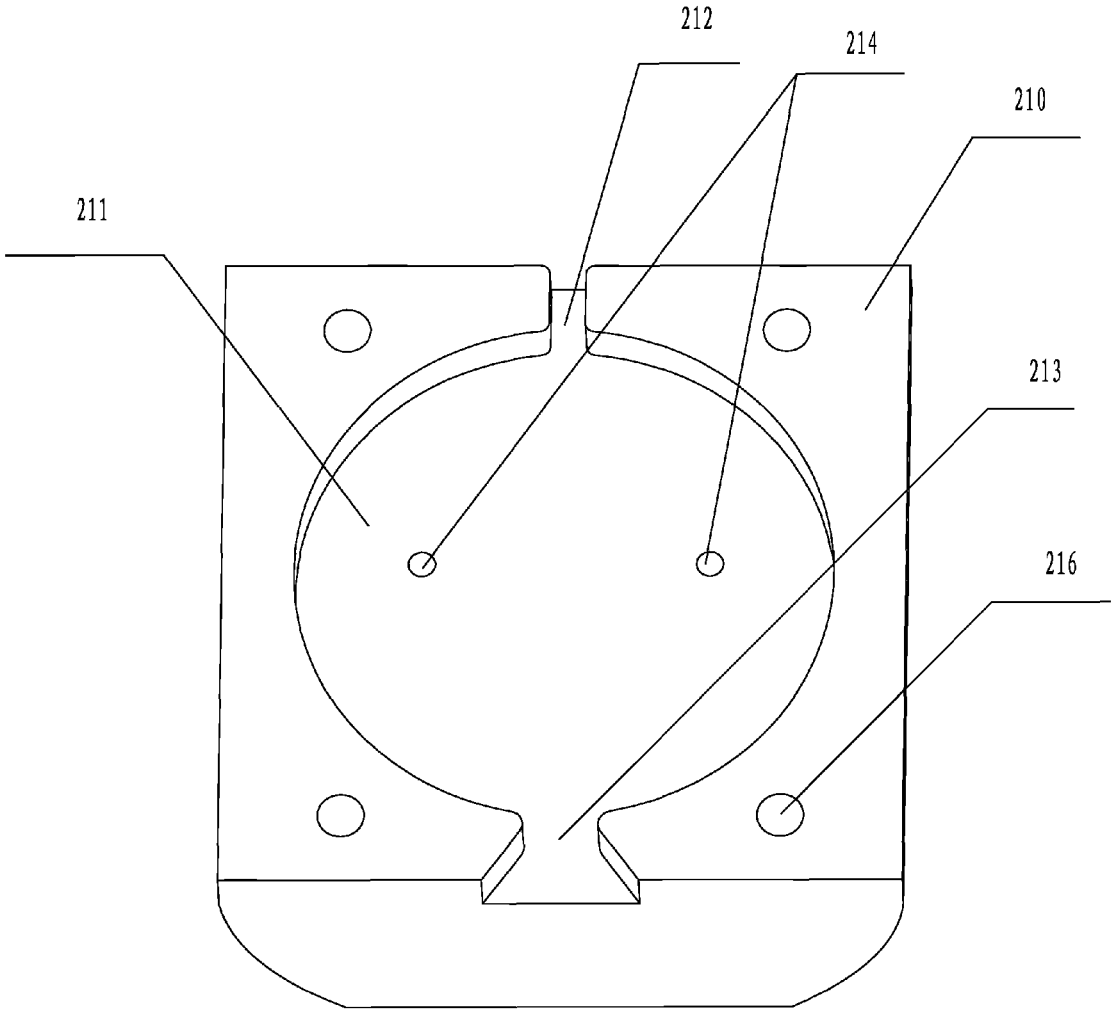
FIG. 3 illustrates the structure of the main water body of a preferred embodiment of the present invention.

An assembly for producing a forficiform spray includes a base body, which is disposed with an inlet nozzle 100 and a cavity body 200. The centre of the inlet nozzle 100 is a hollow inlet waterway 150. One end of the inlet nozzle 100 is disposed with an external threaded 120, the other end is a flanged base 110. The flanged base 110 is disposed with thread holes 130 and through holes 140. The cavity body 200 has a main water body 210 and a cover 220. The upper portion of the cavity body 200 has a thread hole corresponding in position and size to the thread hole 130 of the flanged base 110 of the inlet nozzle 100. The inlet nozzle 100 is fixed to the cavity body 200 by bolts threaded to the thread holes 130.

Thereinto, the centre of the main water body 210 is disposed with a circular groove 211, the bottom of which is in a same horizontal plane.

The centre of the upper end and the center of the lower end of the main water body 210 are disposed with an inlet 211 and an outlet 213 connected to the circular groove 211. The inlet 212 and the outlet 213 are separately disposed in the upper end and the lower end of the circular groove 211 in the radial direction. The upper portion of the outlet 213 is larger than the inlet 212. The upper portion of the outlet 213 is big end down with forktail shape. The inlet 212 and the outlet 213 are chamfered arc. The inlet 212, the circular groove 211 and the outlet 213 form a waterway.

The bottom of the circular groove 211 of the main water body 210 is disposed with two air holes 214, which are symmetrically disposed in two sides of the centre of the lines of the inlet 212 and outlet 213. Two air holes 214 are situated at the bottom of the circular groove 211 near the inlet 212.

The end of the main water body 210 near the inlet 212 is disposed with an airway 215 corresponding to the air hole 214 in quantity and position. The airway 215 is connected to the air hole 214.

The flanged base 110 of the inlet nozzle 100 is disposed with through holes 140 in the position corresponding to the airway 215.

Four corners of the main water body 210 and the cover 220 are separately disposed with a thread hole 216 and a thread hole 221. The main water body 210 is fixed to the cover 220 by a bolt threaded to the thread hole 216 and 221.

The water trend of the present invention during usage is described with reference to the FIG. 4.

Figure 4:
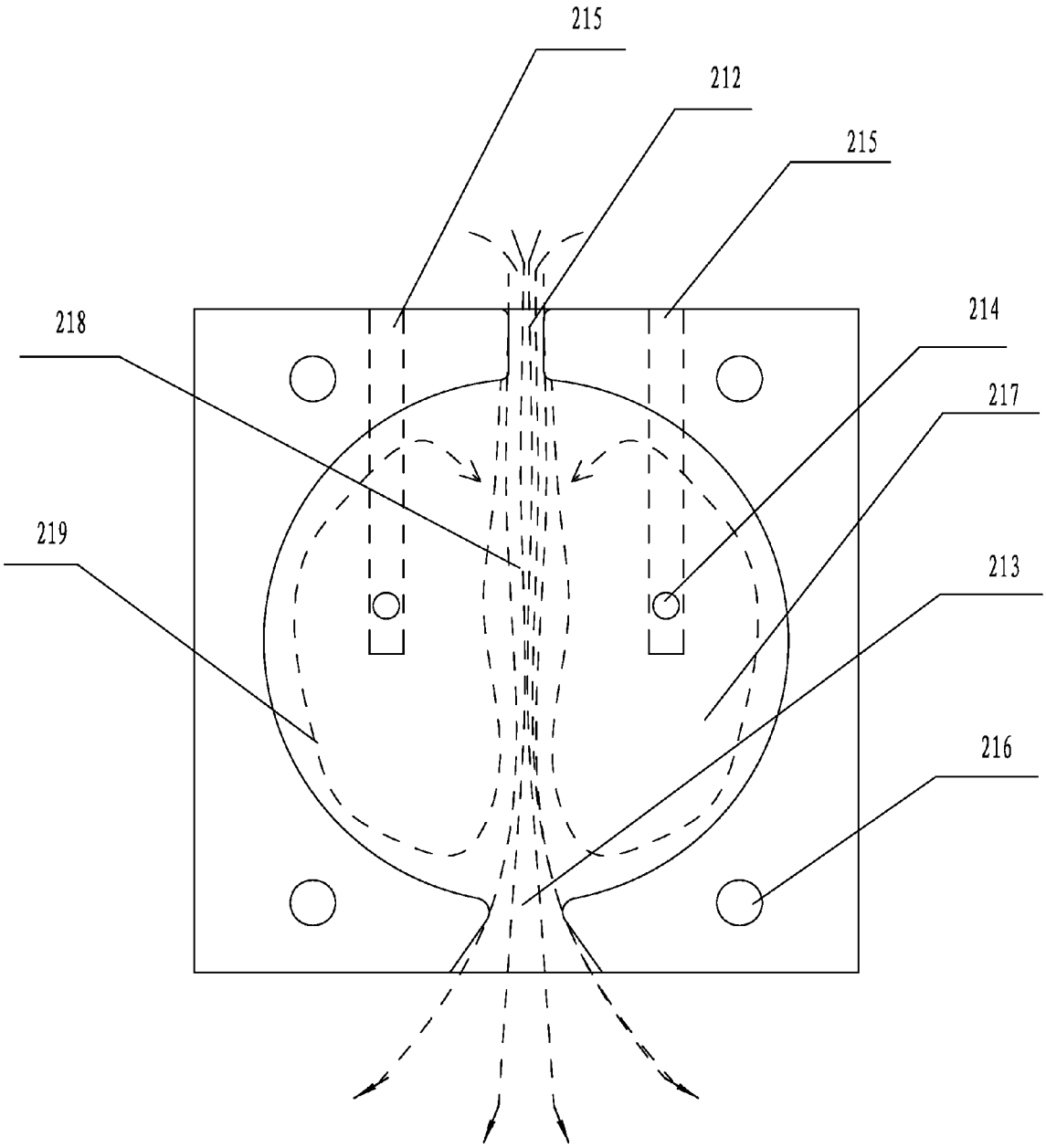
FIG. 4 illustrates the water flowing trend of the present invention.
Figure 5:
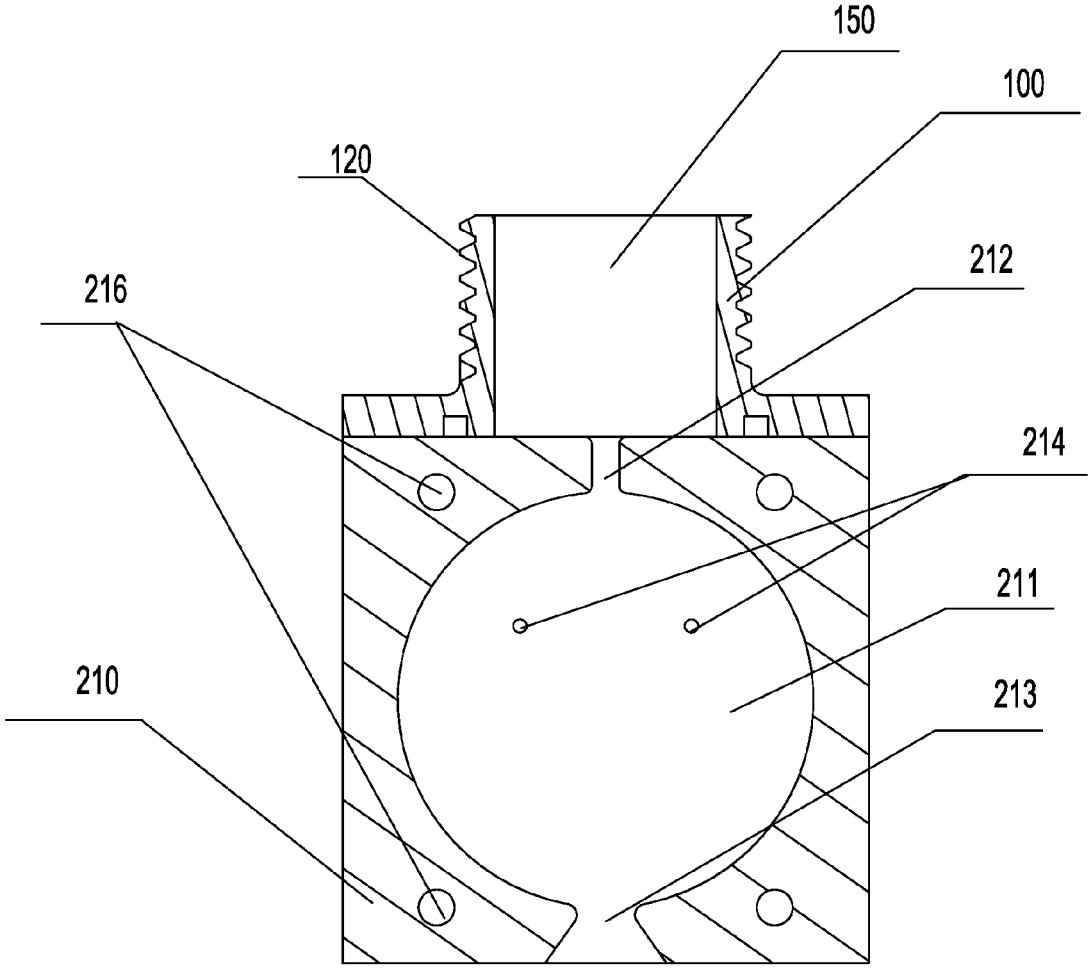
FIG. 5 illustrates the sectional view of the front view of the present invention.
Figure 6:
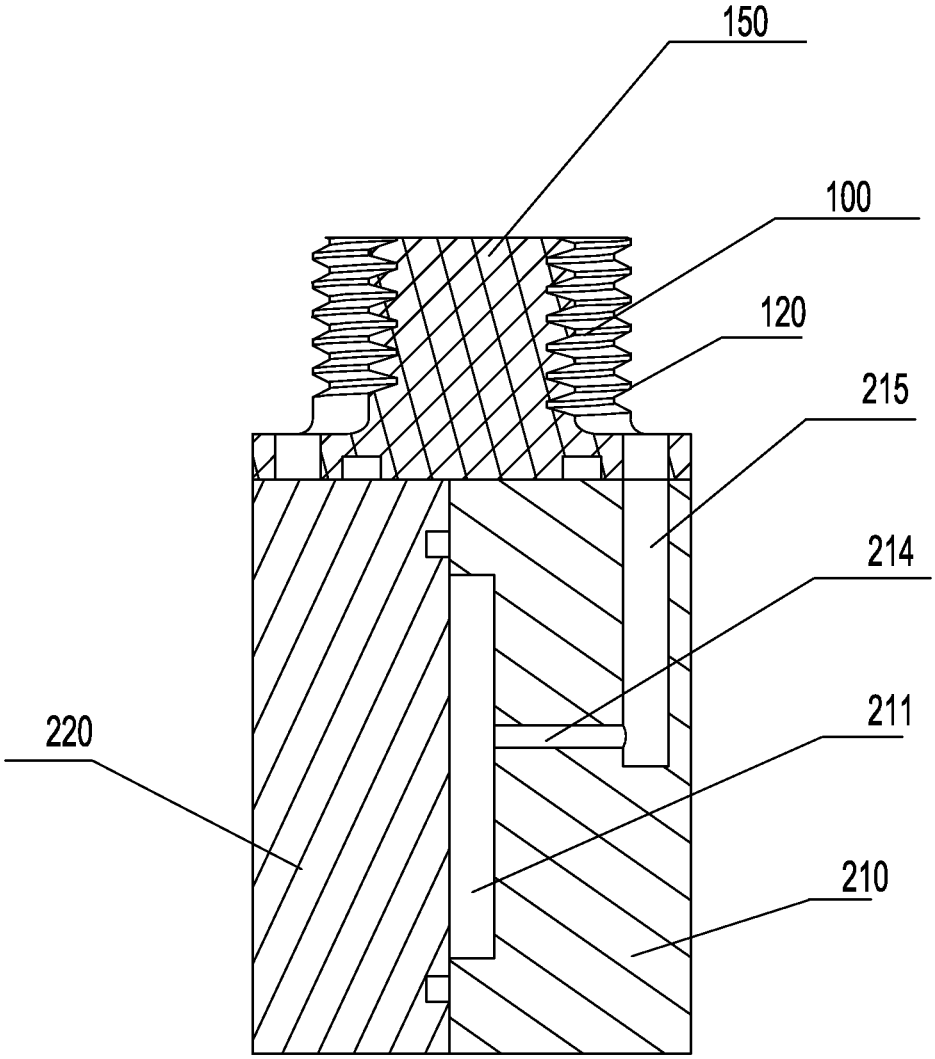
FIG. 6 illustrates the sectional view of the side view of the present invention.
Figure 7:
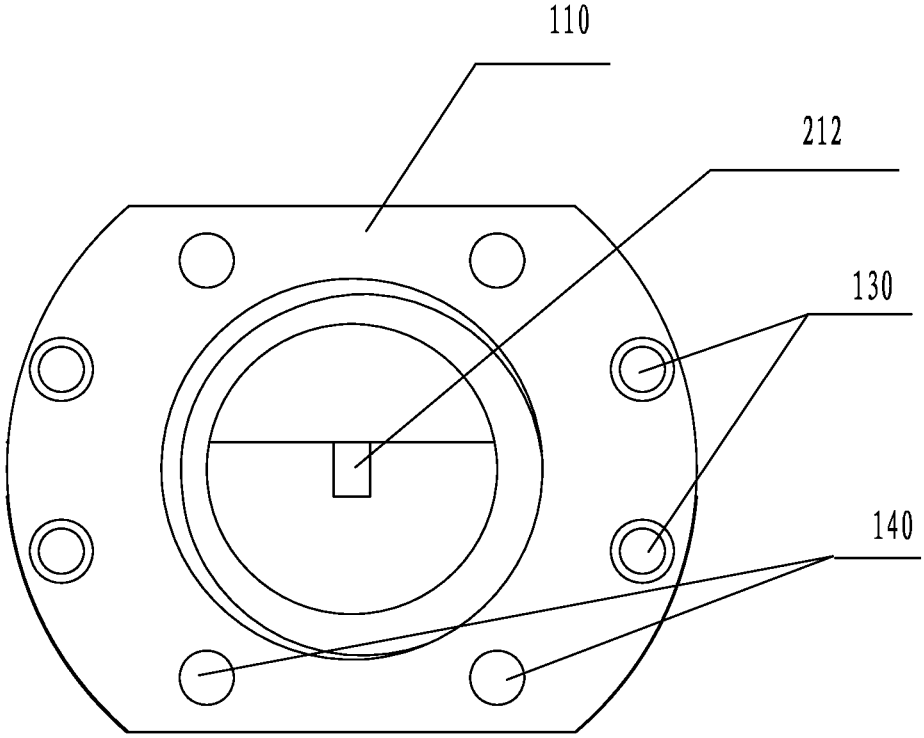
FIG. 7 illustrates the top view of the present invention.

As shown in FIG. 4, when the present invention is used, main water flows to the circular groove 211 from the inlet 212. As the diameter of the inlet 212 is small, the motion energy of the water is increased and the speed of the water is relatively large.

The end of the inlet 212 is a chamfered arc. Water is stagnated here then dispersed when it is running into the circular groove 211. As the diameter of the outlet 213 is slightly larger than that of the inlet 212, one part of the water runs out of the outlet 213, and the other part impacts two circular-like inner walls of the circular groove to form a feedback water 219. The feedback water 219 and the main water 218 from the inlet 212 form a closed water cavity 217. Based on the Bernoulli principle, the closed water cavity 217 is gradually contracted to make the two air holes 214 at the bottom of the circular groove 211 worked with strong suction, causing the air to enter into the circular groove 211 from the airway 215 and the air hole 214. Then air is mixed with the main water, making the specific volume of the mixture doubled and increased. When the mixture is running out of the outlet 213 in high speed, one part adheres to the two sides of the forktail-like outlet 213, increasing the spraying area.

As the speed of the water in the outlet 213 is increased, the other time the volume of the inlet 212 is less than that of the outlet 213, and water in two sides of the outlet 213 is dropping down. One part of the water is directly running out of the outlet 213, reducing the spraying area. The other part of the water impacts the walls of the circular groove 211 again to form feedback water. The feedback water and the main water from the inlet 212 form a closed water cavity 217 again. The closed water cavity 217 is contracted again, making the air hole 214 worked with suction again. The water is again sprayed with a large area from the forktail-like outlet 213, the water spraying area is periodically reduced or increased, similar to a working forficiform, and the outlet water is forficiform water.

INDUSTRIAL APPLICABILITY

The present invention is provided with an assembly for producing forficiform spray, the period of the forficiform spray is stable, the water is full in granule, the suction effect is obvious, and it has good visual effects. When the present invention is assembled in a massage nozzle, the forficiform spray is good for the body with good massage effects. And the assembly is simple in structure and low in cost. It is assembled by bolts, making it easy to clean.

What is claimed is:

1. An assembly for producing a forficiform spray, comprising:

a base body disposed with a waterway therein, the waterway having an inlet, an outlet and a circular cavity connected between the inlet and the outlet, the base body comprising:

a main water body having the inlet, the outlet, and a circular groove that forms the circular cavity connected between the inlet and the outlet, a diameter of the outlet being larger than a diameter of the inlet, the outlet being conical shaped with a big end down, the main water body having an air hole that communicates an inside of the circular cavity with an area outside of the circular cavity;

a cover fixed to the main water body to form a cavity body having threaded holes at an upper end thereof; and an inlet nozzle, a centre of which is a hollow inlet waterway, one end of the inlet nozzle being externally threaded, and another end being a flanged base, the flanged base having threaded holes corresponding to the threaded holes of the cavity body in position and size.

2. An assembly for producing a forficiform spray according to claim 1, wherein a joint of the inlet and the circular cavity is a chamfered arc.

3. An assembly for producing a forficiform spray according to claim 1, wherein a bottom of the circular groove is planar, the inlet and the outlet being separately disposed on respective upper and the lower ends of the circular groove in a radial direction; the outlet being forked tail shaped with the big end down.

4. An assembly for producing a forficiform spray according to claim 3, wherein the air hole is disposed at the bottom of the circular groove in a position near the inlet.

5. An assembly for producing a forficiform spray according to claim 3, wherein the air hole comprises two air holes, each being disposed at the bottom of the circular groove.

6. An assembly for producing a forficiform spray according to claim 5, wherein the two air holes are symmetrically disposed on two sides of a line that passes through the centers of the inlet and the outlet.

7. An assembly for producing a forficiform spray according to claim 3, wherein an end of the base body near the inlet is provided with an airway connected to the air hole.

8. An assembly for producing a forficiform spray according to claim 7, wherein the flanged base of the inlet nozzle has a through hole in a position corresponding to the airway.

9. An assembly for producing a forficiform spray according to claim 8, wherein a main water entering from the inlet is stagnated at a joint between the inlet and the circular groove, and then the water is dispersed when it enters into the circular groove, one portion of the water runs out of the outlet, another portion impacts two circular-like inner walls of the circular groove to form a feedback water; the feedback water and the main water entering from the inlet form a closed water cavity; the closed water cavity gradually contracting to make the air hole at the bottom of the circular groove generate a strong suction, causing air to enter into the circular groove from the airway and the air hole; the air mixing with the main water, making a specific volume of the mixture to double and increase; when the mixture runs out out of the outlet at a high speed, one portion adheres to sides of the outlet, increasing a spraying area; when a volume of the inlet is less than that of the outlet, the water at the sides of the outlet drop down, with a portion of the water directly running out of the outlet, to thereby reduce a spraying area, and with another portion of the water impacting the walls of the circular groove to form feedback water, with the feedback water and the main water from the inlet again forming the closed water cavity, the closed water cavity again contracting, making the air hole generate suction again, so that the water is sprayed with a large area from the outlet.

* * * * *